US012378840B2

(12) United States Patent
Holly

(10) Patent No.: US 12,378,840 B2
(45) Date of Patent: Aug. 5, 2025

(54) HIGH-EXPANSION DYNAMIC INFLATABLE PACKER ELEMENT

(71) Applicant: Halliburton Energy Services, Inc., Houston, TX (US)

(72) Inventor: Mark S. Holly, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/370,056

(22) Filed: Sep. 19, 2023

(65) Prior Publication Data

US 2025/0092758 A1 Mar. 20, 2025

(51) Int. Cl.
*E21B 33/128* (2006.01)

(52) U.S. Cl.
CPC ..... *E21B 33/1285* (2013.01)

(58) Field of Classification Search
CPC ..... E21B 33/1285; E21B 33/127
See application file for complete search history.

(56) References Cited

U.S. PATENT DOCUMENTS 4,611,658 A 9/1986 Salerni et al.
5,101,908 A 4/1992 Mody
5,404,946 A * 4/1995 Hess ..... E21B 33/1275 166/325
6,827,150 B2 12/2004 Luke
8,474,523 B2 7/2013 Rayssiguier et al.
9,243,473 B2 1/2016 Yang et al.
9,316,085 B2 4/2016 Fuglestad
9,506,314 B2 * 11/2016 Roselier ..... E21B 34/10
(Continued)

FOREIGN PATENT DOCUMENTS

GB 2539259 A 12/2016
WO 03054349 A1 7/2003
(Continued)

OTHER PUBLICATIONS

A. E. Verisoken et al. Investigation of Methods for Setting Packers Used for Hydraulic Fracturing, IOP Conference Series: Earth and Environmental Science, 2021, 745 012024.
(Continued)

*Primary Examiner* — Nicole Coy
*Assistant Examiner* — Nicholas D Wlodarski
(74) *Attorney, Agent, or Firm* — Conley Rose, P.C.; Rodney B. Carroll

(57) ABSTRACT

Disclosed embodiments relate to inflatable packer elements, which may be configured to dynamically adjust the axial position of the seal element. The seal element may include an inflatable bladder having a thin-walled skin, which may be radially expanded into sealing position by inflation of the bladder. Embodiments may be configured to dynamically alter the configuration of the bladder by axial movement of the bladder in order to provide additional radial expansion of the bladder. For example, one or both of the top and bottom sides of the seal element bladder may be configured to dynamically translate axially towards the other of the top and bottom sides, which may provide additional material of the thin-walled skin of the bladder capable of expanding radially outward upon inflation. Systems and methods of using and making such packer devices are also disclosed.

14 Claims, 4 Drawing Sheets

(56) References Cited

U.S. PATENT DOCUMENTS

| | | | | |
|---|---|---|---|---|
| 9,708,862 | B2 * | 7/2017 | Hallundbæk | E21B 17/00 |
| 9,725,980 | B2 * | 8/2017 | Hallundbæk | E21B 33/127 |
| 9,816,346 | B2 | 11/2017 | Heggestad | |
| 2004/0055758 | A1 * | 3/2004 | Brezinski | E21B 43/103 166/207 |
| 2006/0042801 | A1 * | 3/2006 | Hackworth | E21B 43/103 166/387 |
| 2006/0102339 | A1 | 5/2006 | Cherewyk | |
| 2012/0261127 | A1 * | 10/2012 | Zhou | E21B 21/103 166/118 |
| 2014/0238689 | A1 | 8/2014 | Hughes et al. | |
| 2015/0300122 | A1 * | 10/2015 | George | E21B 23/06 166/185 |
| 2016/0168943 | A1 | 6/2016 | Hare et al. | |
| 2022/0010651 | A1 * | 1/2022 | Egbe | E21B 33/127 |
| 2022/0136375 | A1 * | 5/2022 | Al-Muraikhi | E21B 47/113 166/250.01 |
| 2022/0389787 | A1 | 12/2022 | Oon et al. | |

FOREIGN PATENT DOCUMENTS

| | | | |
|---|---|---|---|
| WO | 2007031723 | A2 | 3/2007 |
| WO | 2018186869 | A1 | 10/2018 |

OTHER PUBLICATIONS

Foreign Communication from Related Application—International Search Report and Written Opinion of the International Searching Authority, International Application No. PCT/US2023/033712, dated Jun. 10, 2024, 12 pages.

* cited by examiner

HIGH-EXPANSION DYNAMIC INFLATABLE PACKER ELEMENT

FIELD

The present disclosure relates generally to packers for sealing an annular space, for example in a wellbore, and more particularly, to inflatable packers dynamically configured for instances when high-expansion may be useful.

BACKGROUND

In downhole operations, there may be a need to seal an annular space. For example, an annular space between a downhole tool string (which may include any tubing within a well) and a wellbore (e.g. cased or uncased) may need to be sealed, for example to hydraulically isolate a portion of the well. One exemplary type of device used to seal such annular spaces is a packer. A packer is a device that can be used in a well to form an annular seal between an inner tubular member (such as a tool string) and a surrounding outer tubular member (such as a cased or lined wellbore or an open wellbore).

Typically, a packer can be run into a wellbore (e.g. as part of a tool string) while in a first, unexpanded (e.g. run-in) state, and then expanded into a second, expanded (e.g. set) state configured to seal the wellbore. For example, in the first state, the packer may have a smaller outer diameter than the larger (expanded) outer diameter in the second state. Activation, also termed setting, of the packer (e.g. from its initial run-in state to the second, set state) may cause a sealing element of the packer to expand radially outward from the tool string (e.g. to its second expanded state) to sealingly engage the wellbore or other outer tubular member (e.g. forming an annular seal between the tool string and the wellbore or outer tubular member). Packers may also serve to support the tool string within the well. Oftentimes, one or more packer may be employed to isolate one or more section of the wellbore annulus.

BRIEF DESCRIPTION OF THE DRAWINGS

Embodiments of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand.

One or more packer may operate in the wellbore (for example, of a well in a formation having naturally occurring deposits of crude oil and/or natural gas) to fix the tool string relative to a casing or wellbore wall, and may also function to isolate production zones of the well so that hydrocarbon-rich fluids are collected from the wellbore in favor of undesirable fluids (such as water). For example, packers may be used in a completion tool string to provide a seal between the outside of the tubing that forms the tool string (e.g. production string) and a wellbore wall or an interior surface of a casing or liner. Setting the packer may cause the packer to expand in a radial direction, for example to form a seal against the wellbore wall or well casing. In some wells, the packers may be subjected to extreme conditions. For example, wells have been known to reach pressures of up to 30 ksi and temperatures of up to 450° F.

Figure 1:
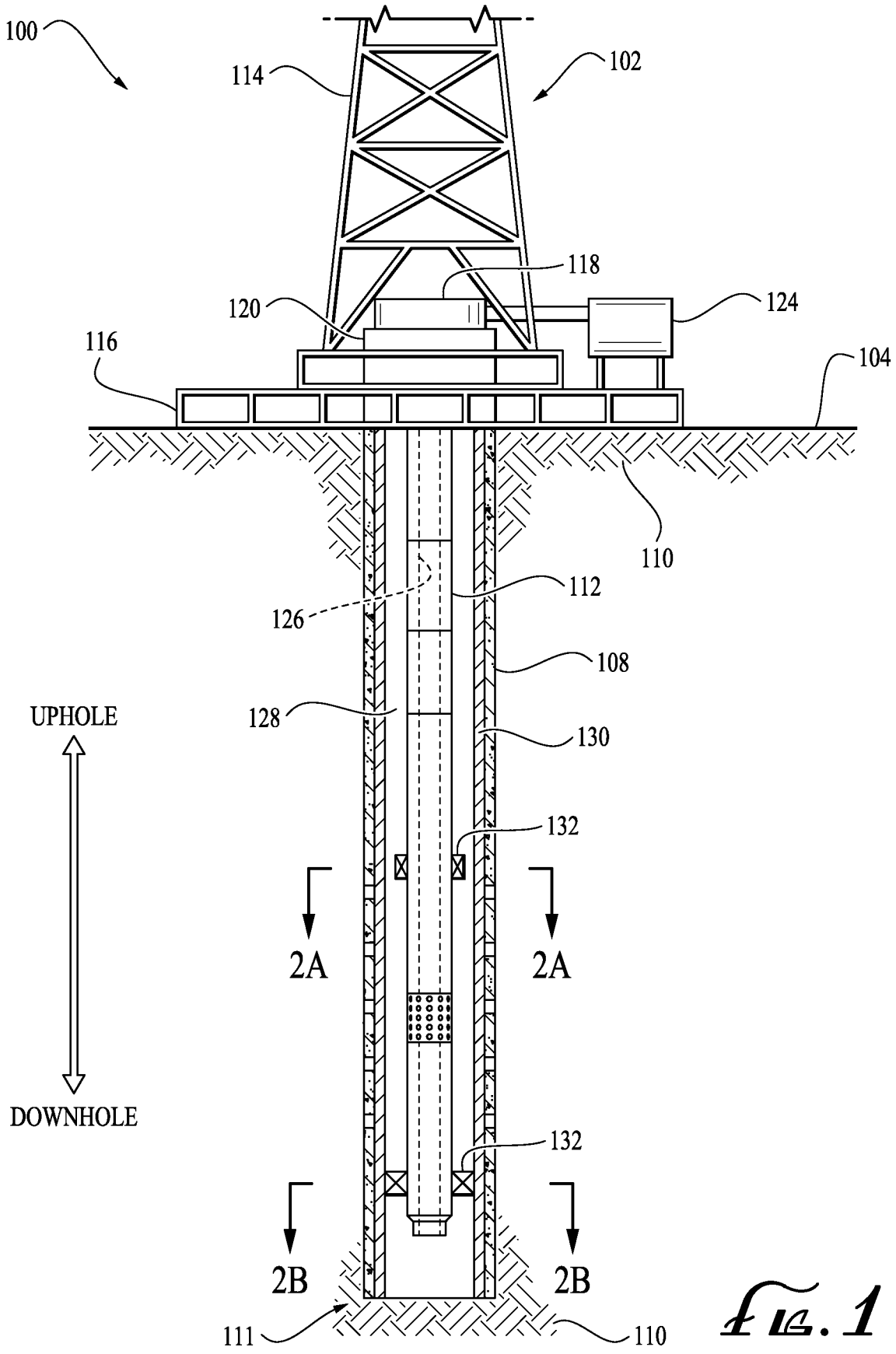
FIG. 1 illustrates a schematic elevation view of an exemplary well in which an exemplary tool string has been deployed, according to embodiments of this disclosure.

FIG. 1 illustrates a schematic, elevation view of an exemplary embodiment of a tool string 112 disposed within an exemplary well, in which the packer(s) 132 is shown in a deployed state in a lower zone and an undeployed state in an upper zone, for example to isolate a portion of the formation. While the operating environment is shown in FIG. 1 with respect to a stationary, land-based rig for raising, lowering, and setting a production tool string 112, in alternative embodiments, mobile rigs, wellbore servicing units (e.g., coiled tubing units, slickline units, or wireline units), and the like may be used to lower the production tool string 112. Furthermore, while the operating environment is generally discussed as relating to a land-based well, the systems and methods described herein may instead be operated in subsea well configurations, for example accessed by a fixed or floating offshore platform, drill ships, semi-submersibles, and/or drilling barges (not expressly shown). Additionally, while wellbore 108 is shown as being a generally vertical wellbore, wellbore 108 may be or include any orientation, including generally horizontal, multilateral, or angularly directional.

FIG. 1, illustrates a production system 100 that includes a packer assembly 132. The production system 100 includes a rig 102 atop a surface 104 of a well. Beneath the rig 102, a wellbore 108 is formed within a geological formation 110, which may be expected to produce hydrocarbons or other fluids. The wellbore 108 may be formed in the geological formation 110 using a drill string that includes a drill bit to remove material from the geological formation 110. The wellbore 108 of FIG. 1 is shown as being near-vertical, but may for example be formed at any suitable angle to reach a hydrocarbon-rich portion of the geological formation 110. In some embodiments, the wellbore 108 may follow a vertical, partially-vertical, angled, or even a partially-horizontal path through the geological formation 110, extending from the surface 104 to an exemplary toe 111.

A production tool string 112 is deployed from the rig 102, which may be a drilling rig, a completion rig, a workover rig, or another type of rig. The rig 102 can include a derrick 114 and a rig floor 116. The production tool string 112 in FIG. 1 extends downward through the rig floor 116, through a fluid diverter 118 and blowout preventer 120 (which may be configured as or include a nipple in some embodiments) that provide a fluidly sealed interface between the wellbore 108 and external environment, and into the wellbore 108 and geological formation 110. The production tool string 112 is shown in installed/deployed position in FIG. 1. However, prior to or following installation, the production system 100 may also include a motorized winch and other equipment for extending the production tool string 112 into the wellbore 108, retrieving the production tool string 112 from the wellbore 108, positioning the production tool string 112 at a selected depth within the wellbore 108, or for lowering diagnostic, repair, or other equipment into the production tool string 112 by (for example) wireline or slickline.

A pump 124 can be coupled to the fluid diverter. The pump 124 may be operational to deliver or receive fluid through a fluid bore 126 (e.g. longitudinal bore) of the production tool string 112 by applying a positive or negative pressure to the fluid bore 126. In FIG. 1, the pump 124 is disposed at the surface 104. Although not explicitly shown herein, in some embodiments the pump or one of a plurality of pumps may be disposed within the wellbore 108. For example, an electrical submersible pump (ESP) may be included in the tool string 112. As referenced herein, the fluid bore 126 is the flow path of fluid from an inlet of the production tool string 112 to the surface 104. The pump 124 may also deliver positive or negative pressure through an annulus 128 formed between the wall of the wellbore 108 and exterior of the production tool string 112. In FIG. 1, the annulus 128 is formed between the production tool string 112 and a wellbore casing 130 when production tool string 112 is disposed within the wellbore 108. As referenced herein, the term "casing" may be used interchangeably with the term "liner" to indicate tubing that is used to line or otherwise provide a barrier along a wellbore wall. Such casings may be fabricated from composites, metals, plastics, or any other suitable material.

Following formation of the wellbore 108, the production tool string 112 may be equipped with tools and deployed within the wellbore 108 to prepare, operate, or maintain the well 106. Typically, the tool string 112 may be conveyed/deployed into the wellbore 108 and thereby moved and positioned downhole within the wellbore 108 by a conveyance mechanism. For example, the conveyance mechanism may be drill pipe extending downhole in some embodiments, or alternatively, coiled tubing or a wireline. The production tool string 112 may incorporate tools that can be actuated after deployment in the wellbore 108, including without limitation one or more packer 132. The packer 132 generally remains in the first (e.g. run-in) state as it is run into the wellbore 108 for installation and until the packer 132 is actuated and set within the wellbore 108. Upon actuation, the expandable sealing element of the packer 132 extends radially (e.g. to the second, set state), for example to engage and form a seal against the well casing or wellbore wall.

In some embodiments, actuation of the packer 132 may result in approximate centering the production tool string 112 within the wellbore 108, anchoring the production tool string 112, isolating a segment or zone of the wellbore 108 from other segments or zones, and/or other functions related to positioning and operating the production tool string 112. In the illustrative embodiment shown in FIG. 1, the production tool string 112 is depicted with two packers 132 (e.g. an upper packer disposed uphole and a lower packer disposed downhole) for isolating segments of the wellbore 108. The packers 132 may be used to prepare the wellbore 108 for hydrocarbon production (e.g., fracturing) or for service during formation (e.g., acidizing or cement squeezing). In FIG. 1, the exemplary upper packer 132 is shown in its first (e.g. run-in) state and the exemplary lower packer 132 is shown in its second (e.g. expanded/set) state to form a seal against the wall of the wellbore 108 and the production tool string 112 to prevent fluids from regions in the formation 110 below the packer 132 from interacting with the production tool string 112 thereabove.

Figure 2A:
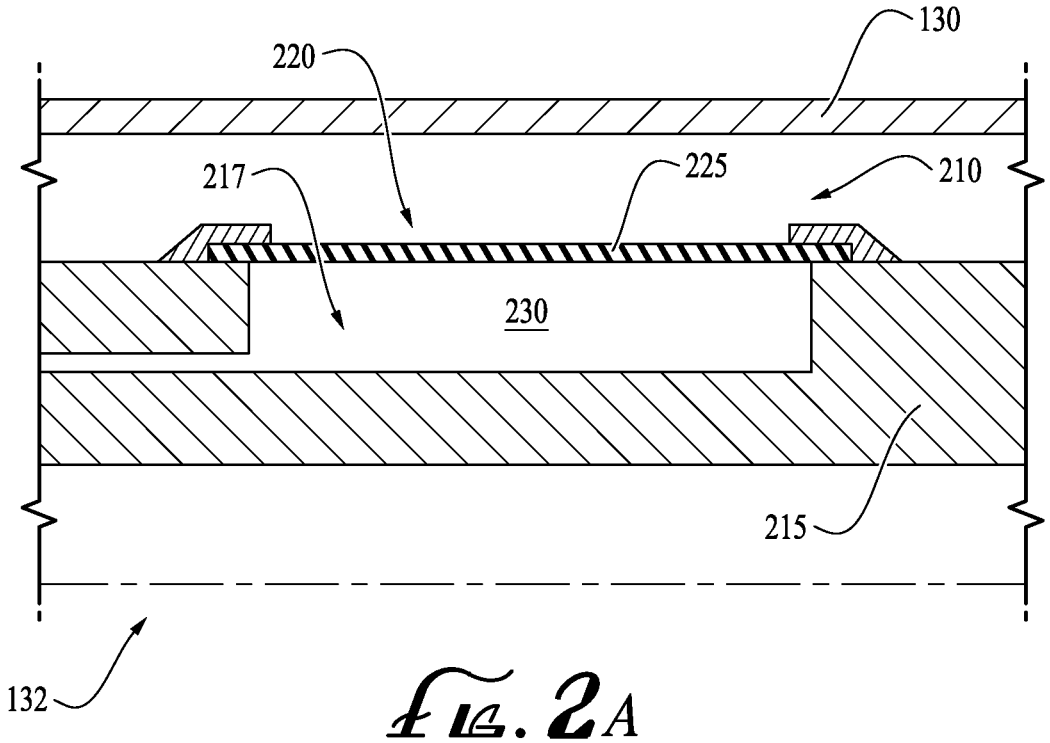
FIG. 2A illustrates a schematic partial longitudinal cross-sectional view of an exemplary packer in run-in state, according to embodiments of this disclosure.
Figure 2B:
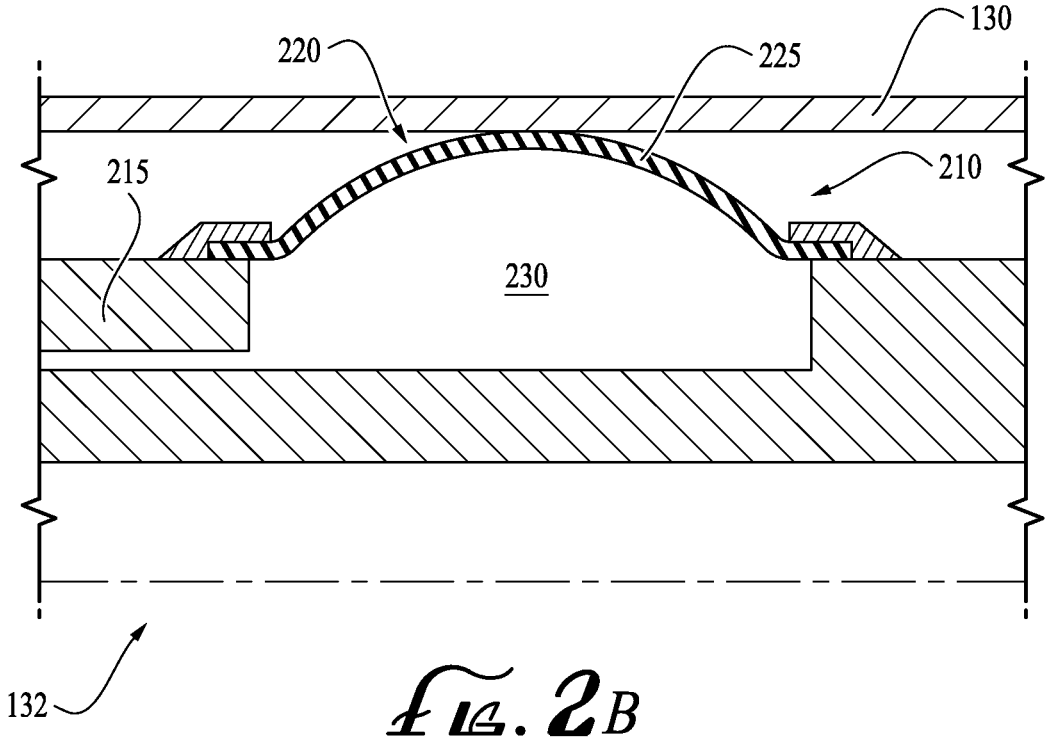
FIG. 2B illustrates a schematic partial longitudinal cross-sectional view of the packer of FIG. 2A in set state, according to embodiments of this disclosure.

While there are different types of packers, for example configured for actuation using different techniques and/or including different elements, FIGS. 2A-2B illustrate an exemplary inflatable packer 132, in which the packer 132 is configured to expand radially from the first state (e.g. the initial or run-in state, as shown in FIG. 2A) to the second state (e.g. the expanded or set state, as shown in FIG. 2B) due to the introduction of pressurized fluid therein. For example, the packer 132 of FIG. 2A may comprise a sealing element 210 having an inflatable bladder 220 disposed on a mandrel 215. In embodiments, the mandrel 215 may be a cylindrical or tubular element which can be made up as part of the tool string 112 (e.g. configured to attach to other tubular elements in the tool string 112, e.g. at the top and/or bottom of the mandrel 215, and typically having a longitudinal bore therethrough in fluid communication with the longitudinal bore of the other tubular elements of the tool string 112) and which is configured to support the sealing element 210. In embodiments, the inflatable bladder 220 of the sealing element 210 may be disposed radially about an exterior of the tubular body of the mandrel 215 (e.g. extending circumferentially around the mandrel 215).

In embodiments, the inflatable bladder 220 may be mounted to the exterior surface of the mandrel 215. For example, the inflatable bladder 220 may comprise a thin-walled skin 225 configured to define an interior space 230 which may be expanded (e.g. by introduction of pressurized fluid therein) into the second, set state by inflation of the bladder 220. For example, the mandrel 215 may include a cavity 217 in its outer surface, which may extend circumferentially around the mandrel 215, and the thin-walled skin 225 of the bladder 220 may extend over the cavity 217 (e.g. to seal the cavity 217). In embodiments, the top and bottom of the bladder 220 may be (sealingly) coupled to the mandrel 215. Prior to inflation (e.g. when the bladder 220 is in the first state, as shown in FIG. 2A), the thin-walled skin 225 may be substantially taut and/or substantially flat against the exterior of the mandrel 215 and/or may not extend substantially beyond the outer diameter of the mandrel 215, as shown in FIG. 2A. After inflation of the bladder 220 (e.g. by introduction of pressurized fluid therein), the thin-walled skin 225 may bow out, bellow outward, and/or expand radially outward to extend beyond the outer diameter of the mandrel 215 (e.g. with the bladder 220 in the second, set state having an outer diameter grater than the outer diameter of the mandrel 215), as shown in FIG. 2B.

In the embodiments shown in FIGS. 2A-2B, the amount of radial expansion of the bladder 220 may depend upon the material properties of the thin-walled skin 225. For example, the thin-walled skin 225 of FIGS. 2A-2B may be formed of elastomeric material. While the expansion of the bladder 220 may also depend on the pressure introduced within the bladder 220, the limits of such pressure may be set depending on the material properties (e.g. elasticity, tensile strength, and/or ductility) of the thin-walled skin 225. Thus, this configuration of inflatable bladder packer 132 may limit the amount of expansion, as well as the materials that can effectively be used for the thin-walled skin 225. In this configuration, it may be necessary to use a greater axial length of thin-walled skin 225 (e.g. the distance extending axially between the anchor points at which the top and bottom of the thin-walled skin 225 are coupled rigidly to the mandrel 215 over the cavity 217) in order to increase the inflated/expanded outer diameter of the bladder 220 in the second state. However, this option may be limited due to sizing constraints in some embodiments.

Figure 3A:
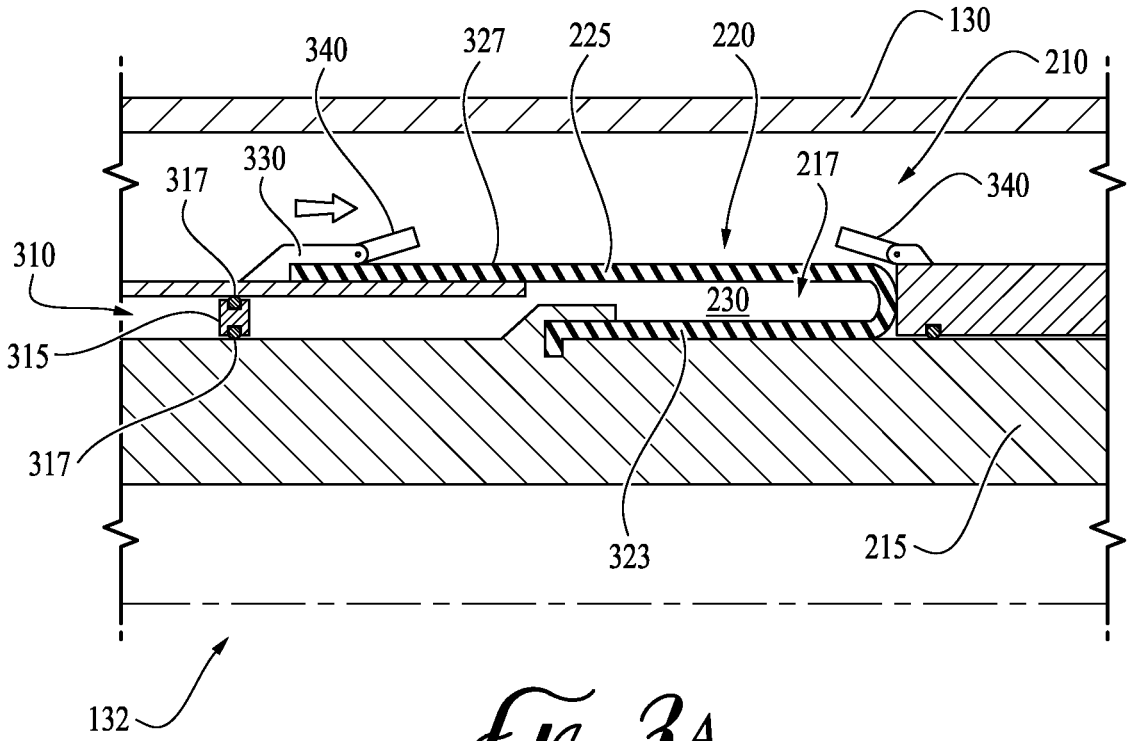
FIG. 3A illustrates a schematic partial longitudinal cross-sectional view of another exemplary packer embodiment in run-in state, according to embodiments of this disclosure.
Figure 3B:
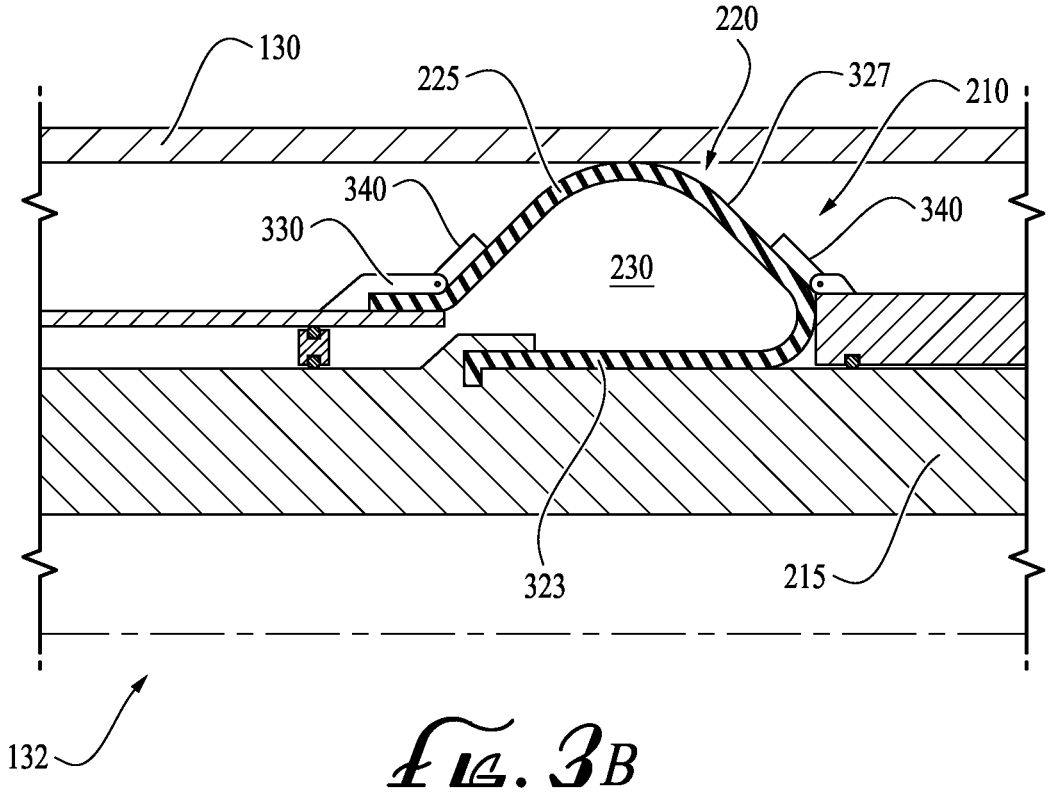
FIG. 3B illustrates a schematic partial longitudinal cross-sectional view of the packer of FIG. 3A in set state, according to embodiments of this disclosure.

FIG. 3A-3B illustrate an alternative packer 132 embodiment, which may be configured to address one or more of the concerns arising from the earlier static configuration (e.g. as illustrated in FIGS. 2A-B). The embodiment shown in FIGS. 3A-3B may be particularly effective for high-expansion packer 132 elements, in which the expanded outer diameter of the second state is significantly greater than initial diameter of the first state. For example, high-expansion packer 132 elements may be particularly useful when expansion needed for a situation (e.g. to seal the annulus) is greater than 150% or greater than 180% (e.g. when the percentage is the ratio of the final expansion to seal the wellbore diameter versus the RIH (run in hole) diameter or unexpanded diameter).

The packer 132 embodiment of FIG. 3A may be configured to dynamically adjust the position/configuration of the sealing element 210 on the mandrel 215 in a way that may provide for additional radial expansion of the sealing element 210. Again (similar to the discussion above with respect to FIGS. 2A-2B), the sealing element 210 may include an inflatable bladder 220 having a thin-walled skin 225, which may be expanded into sealing state (e.g. the second state) by inflation of the bladder 220 (e.g. by introduction of pressurized fluid therein). Embodiments of the packer 132 may be configured to dynamically alter the configuration/position of the bladder 220 by axial movement of the bladder 220, in order to provide additional radial expansion of the bladder 220. For example, one or both of the top and bottom sides of the bladder 220 may be configured to dynamically translate axially towards the other of the top and bottom sides of the bladder 220, which may provide additional material of the thin-walled skin 225 of the bladder 220 which is then capable of expanding radially outward upon inflation. As used herein, the top of the bladder 220 is the portion of the bladder 220 disposed uphole, while the bottom of the bladder 220 is the portion of the bladder 220 disposed downhole.

Figure 4:
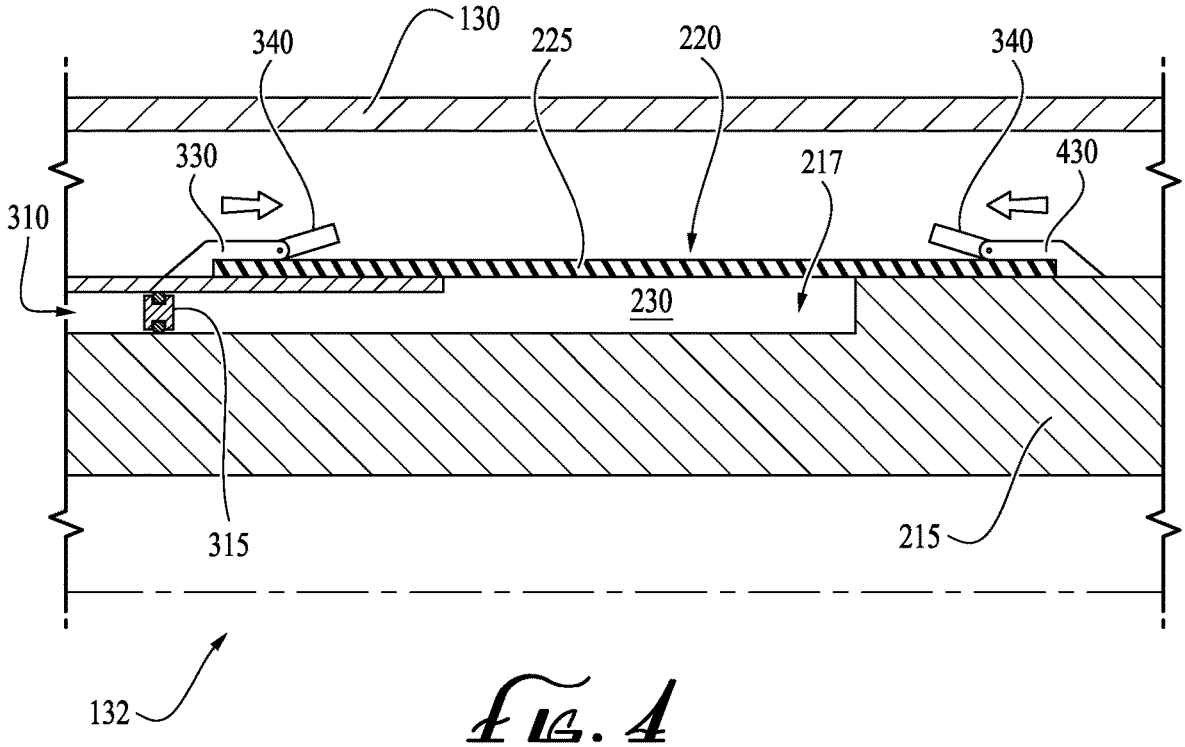
FIG. 4 illustrates a schematic partial longitudinal cross-sectional view of yet another exemplary packer embodiment in run-in state, according to embodiments of this disclosure.

As shown in FIGS. 3A-3B, the exemplary packer 132 has a mandrel 215 with a tubular body (for example, with a longitudinally extending bore therethrough which has an axis) and a sealing element 210 (e.g. sleeve). The sealing element 210 has an inflatable bladder 220 disposed about the exterior of the mandrel 215 tubular body, which may be configured so that inflation of the bladder 220 results in radial expansion of the bladder 220. Embodiments may also include an actuation element/mechanism configured to inflate the bladder 220 upon actuation. As shown in FIGS. 3A and 4, the bladder 220 is secured to the mandrel 215, with at least one of a top and a bottom of the bladder 220 being configured to dynamically translate (e.g. move or displace) axially toward the other of the top and the bottom of the bladder 220 upon actuation of the packer 132 (e.g. responsive to inflation of the bladder 220, responsive to injection of pressurized fluid into the bladder 220, responsive to movement of the actuation mechanism, etc.).

FIG. 3A illustrates the packer 132 embodiment in its first, run-in state in which the bladder 220 is uninflated (e.g. the outer diameter of the bladder 220 may be substantially the same as the outer diameter of the mandrel 215). FIG. 3B illustrates the packer 132 embodiment in its second, set state in which the bladder 220 is inflated/expanded (e.g. having an outer diameter significantly larger than the run-in outer diameter and/or configured to seal an annulus of a wellbore 108 to prevent passage of fluid in the annulus, for example with the set state outer diameter approximately equal to the inner diameter of the wellbore). In the embodiment shown in FIG. 3A, the actuation mechanism comprises a pressure injection mechanism 310 configured to inflate the bladder 220 upon actuation (e.g. by injecting pressurized fluid or other filling material therein).

In embodiments, the bladder 220 may be secured to the mandrel 215 by having both the top and the bottom of the bladder 220 secured to the mandrel 215, although in FIG. 3A at least one of the top or bottom of the bladder 220 may be secured to the exterior of the mandrel 215 in a manner allowing for dynamic axial translation thereof. Such dynamic packer 132 configurations with axial translation may provide one or more benefits compared to static packer configurations. In some embodiments, axial translation of the bladder 220 may be configured to produce/allow greater radial expansion of the bladder 220 during inflation. For example, radial expansion of the bladder 220 in embodiments may be greater than 150%, greater than 180%, from about 150-400%, from about 180-400%, from about 180-300%, from about 180-200%, from about 200-400%, from about 300-400%, from about 200-300%, or even over 400% in some embodiments (e.g. based on the final outer dimeter of the packer compared to the initial outer diameter of the packer). In some embodiments, stress in the thin-walled skin 225 of the bladder 220 while the bladder 220 is in the second, set state (see FIG. 3B) may be significantly lower than if no axial translation had occurred, while providing the same amount of radial expansion. In some embodiments, greater radial expansion may be possible with dynamic packer 132 configurations (compared to static configurations), with less sealing element 210 length. For example, axially shorter packers may be used while providing sufficient high-expansion sealing. By way of example, the packer 132 embodiments having axial translation may be approximately ⅓ the axial length of a standard packer without axial translation which is capable of sealing the same diameter of wellbore.

In the packer 132 embodiment shown in FIGS. 3A-3B, one of the top and the bottom of the bladder 220 is configured for axial translation, while the other of the top and the bottom of the bladder 220 is fixed (e.g. is configured to not allow axial translation during actuation/inflation). In FIG. 3A, the bottom of the bladder 220 is axially fixed, while the top of the bladder 220 is configured to allow for axial translation (as discussed in more detail herein). Other embodiments may be similar but oriented in reverse, for example having the top of the bladder 220 axially fixed and the bottom of the bladder 220 configured to allow for axial translation. In still other embodiments (e.g. as shown in FIG. 4), both the top and bottom of the bladder 220 may be configured for axial translation (e.g. towards each other and/or towards a cavity 217 in the mandrel 215).

In embodiments, the mandrel 215 may have a cavity 217 in its exterior surface. For example, the cavity 217 may be an inset portion of the mandrel 215, typically extending circumferentially around the mandrel 215. The bladder 220 may comprise a thin-walled skin 225 disposed over (e.g. covering) the cavity 217. In embodiments, the thin-walled skin 225 may comprise a sleeve disposed about the mandrel 215, which may be sealingly attached to the mandrel 215 (e.g. in proximity to the cavity 217) in some embodiments. In embodiments, the thin-walled skin 225 may span the opening of the cavity 217 to create the interior space 230 for inflation via the pressurized fluid/materials (e.g. with only an opening in fluid communication with the piston port). In embodiments, the interior space 230 of the bladder 220 for inflation may be formed between the thin-walled skin 225 and an inner surface of the cavity 217 of the mandrel 215. For example, the interior space 230 may be the space of the cavity 217 sealingly covered by the thin-walled skin 225 (e.g. as shown in FIG. 4), and pressure may be injected into the sealed cavity 217. In other embodiments, the interior space 230 of the bladder 220 may be disposed within an envelope formed by the thin-walled skin 225 (e.g. between an inner panel 323 and an exterior panel 327 of the thin-walled skin 225), and pressure may be injected into the interior space 230 of the bladder 220. In embodiments, the thin-walled skin 225 may comprise an inner panel 323 disposed in contact with, against, and/or in proximity to an inner wall of the cavity 217. For example, the inner panel 323 may extend substantially a length of the cavity 217 (e.g. from the bottom of the bladder 220 to the top of the bladder 220). The thin-walled skin 225 may further comprise an exterior panel 327 spanning the cavity 217, with the inner panel 323 connected to the exterior panel 327 of the thin-walled skin 225 to form the envelope disposed within the cavity 217 and configured to expand upon inflation. Some embodiments may have such a bladder 220 disposed on the mandrel without being disposed within a cavity. In embodiments, the bottom of the bladder 220 in FIG. 3A may be attached to the mandrel 215 (e.g. with the envelope of thin-walled skin 225 adhered to a lower wall of the cavity 217 of the mandrel 215). In other embodiments, the bottom of the bladder 220 envelope may otherwise be retained within the cavity. This envelope configuration may reduce the number of seals needed to form the inflatable bladder 220 (e.g. by eliminating a seal on the bottom of the bladder 220), which may improve durability, reliability, and/or seal life.

In embodiments, the pressure injection mechanism 310 may be configured to hydraulically inject fluid into the interior space 230 of the bladder 220. For example, the pressure injection mechanism 310 may comprise a piston 315 disposed in the mandrel 215 (e.g. in a cylinder formed in the mandrel 215) and in fluid communication with the interior space 230 of the bladder 220. The piston 315 may be configured to inject material, such as pressurized fluid, into the bladder 220 upon actuation (for example material/fluid held in the cylinder between the piston and the bladder). Embodiments of the piston 315 may comprise one or more seal 317, which may be configured to prevent fluid in the bladder 220 from leaking therepast (e.g. into the cylinder of the mandrel 215). In some embodiments, the piston 315 may be actuated by pressure supplied (e.g. from the surface) by hydraulic fluid (e.g. in the cylinder on the side of the piston opposite the bladder 220). In embodiments, the piston 315 may include a check valve, which may be configured to allow for passage of hydraulic fluid for activation of the piston 315 into the interior space 230 of the bladder 220 for inflation of the bladder 220 (e.g. after the compression stroke of the piston 315 is completed).

While the description above relates to an inflation mechanism that may be integral to the packer 132, in other embodiments the inflation mechanism may be a separate tool configured to inflate the bladder 220 of the packer 132. In some such embodiments, there may be a port in the packer in fluid communication with the interior space 230 of the bladder 220, which is configured for interaction to provide fluid communication with the separate inflation tool. For example, the separate inflation tool may plug into the port, thereby unsealing the (previously sealed) port (which is in fluid communication with the interior space 230 of the bladder 220), thereby placing the separate inflation tool in fluid communication with the interior space 230 of the bladder 220. In some embodiments, when the separate inflation tool is removed (e.g. breaking connection with the port), the port may be configured to seal once again. In other embodiments, the interior space of the bladder 220 may be a sealed space with no communication ports, and the separate inflation tool may be configured to inflate the bladder 220 directly. Persons of skill will understand these and other separate inflation tool approaches.

In some embodiments, the thin-walled skin 225 may have a surface that is impenetrable to fluid (e.g. wellbore fluid) and/or is configured to contain pressurized fluid therein. For example, such a thin-walled skin 225 may be used when pressurized fluid is used to inflate/expand the bladder sealing element 210. In other embodiments, the thin-walled skin 225 may comprise one or more openings or pores, with the opening size sufficiently small to retain injected material in the bladder 220. For example, such a thin-walled skin 225 may be used when using a more viscous, thick, or clumpy injected material to inflate the bladder 220, and/or when the injected material is capable of solidifying (e.g. with the thin-walled material retaining the injected material while it solidifies). In embodiments, the solidified material may be configured to form the annular seal (e.g. the solidified material itself may provide the seal, since the openings in the thin-walled skin 225 may prevent it from effectively sealing). By way of example, the thin-walled skin 225 may comprise a mesh surface, wherein the mesh size is sufficiently small to retain injected material in the bladder 220 (e.g. while it solidifies).

In embodiments, the pressurized fluid can be wellbore fluid. In other embodiments, the pressurized fluid may not be wellbore fluid (e.g. may be different than wellbore fluid, such as hydraulic fluid). In some embodiments, the injected material retained in the bladder 220 may be configured to be flowable initially (e.g. during injection) and to solidify and/or seal while disposed/held within the bladder 220. By way of example, the injected material retained in the bladder 220 may comprise uncured cement. In some embodiments, the injected material may further comprise a retardant additive configured to delay setting of the cement. This may allow for effective loading of the packer 132 with the cement in advance of injection (e.g., at the surface, before insertion of the tool string 112 downhole), while allowing the cement to remain sufficiently flowable for injection once the packer 132 is in place within the wellbore 108. In still other embodiments, the material injected to inflate the bladder 220 may comprises reactants, for example of a two-part epoxy or foam. For example, injection of the material may comprise breaking, opening, unsealing, or piercing containers holding the reactants separately to allow mixing thereof. The reactants in the interior space 230 of the bladder 220 may react, for example to solidify therein. Alternatively, inflation of the bladder 220 may occur by introduction of swellable materials, such as a two-part resin, metal, or elastomers, into the interior space 230 of the bladder 220.

In some embodiments, a ratchet 330 can be used to provide the axial movement of the bladder 220. For example, the embodiment of FIG. 3A may further comprise a ratchet 330 configured for axial translation in one direction (e.g. towards the cavity 217 and/or the bladder 220), while preventing axial translation the opposite direction (e.g. away from the cavity 217 and/or bladder 220). The ratchet 330 can secure one of the top or bottom of the bladder 220 to the mandrel 215. For example, the thin-walled skin 225 can be fixedly attached to the ratchet 330, and the ratchet 330 can be attached to the exterior of the mandrel 215 so as to allow/provide axial translation of the bladder 220. Some embodiments (e.g. as shown in FIG. 4) may further comprise a second ratchet 430 disposed opposite the first ratchet 330 with the cavity 217 therebetween, and the second ratchet 430 may secure the other of the top or bottom of the bladder 220 to the mandrel 215 (e.g. similar to the first ratchet 330 arrangement). The second ratchet 430 may similarly be configured for axial translation towards the cavity 217 and/or the bladder 220, while preventing axial translation the opposite direction (e.g. away from the cavity 217 and/or bladder 220). In some embodiments, a first ratchet 330 may be disposed uphole of the cavity 217 on the mandrel 215, while the second ratchet 430 may be disposed downhole of the cavity 217 on the mandrel 215. There may be a seal at an interface between the bladder 220 and the one or more ratchet 330, for example to provide the sealed interior space 230.

In some embodiments, the thin-walled skin 225 may be elastomeric (e.g. comprising elastomeric material), while in other embodiments the thin-walled skin 225 may be non-elastomeric. In embodiments, the thin-walled skin 225 can be formed of or comprise a metal. For example, the thin-walled skin 225 may be formed of ductile steel, such as 316 stainless steel. In some embodiments, the thin-walled skin 225 can be formed of or comprise composite material (such as carbon fiber impregnated elastomer). The dynamic packer 132 design of FIGS. 3A-4 may allow for the use of materials, such as metals and composites, which may not effectively function to seal the annulus in static packer elements. Using metal thin-walled skin 225 material may allow for improved packer 132 performance in wellbore conditions (especially in high-expansion, high-temperature, and/or high-pressure situations).

Figure 3C:
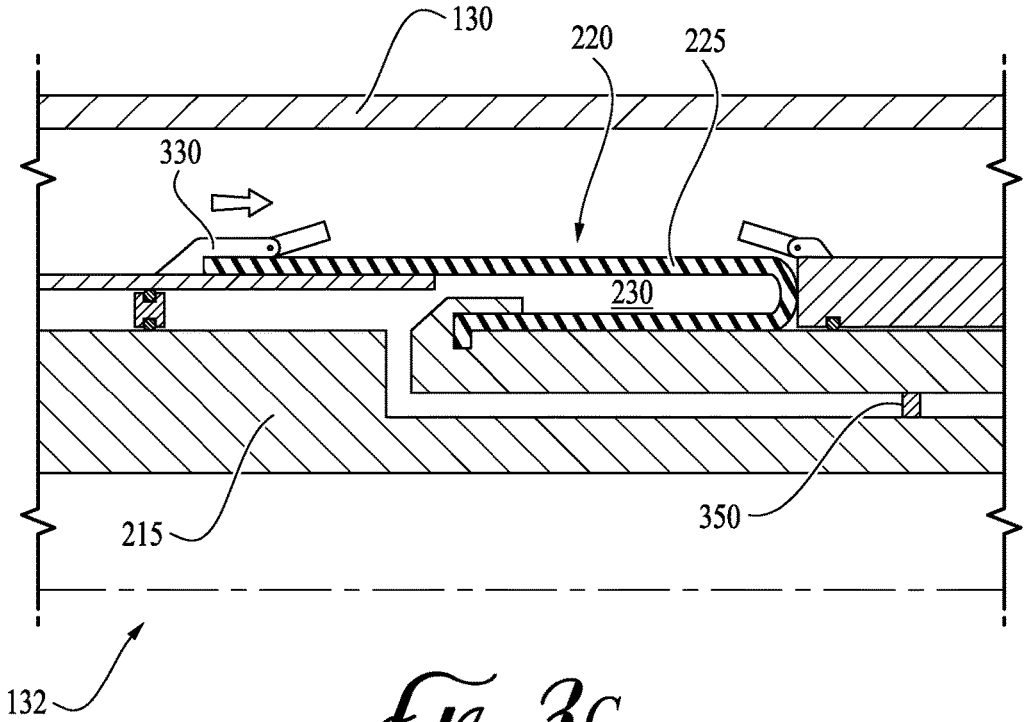
FIG. 3C illustrates a schematic partial longitudinal cross-sectional view of another exemplary packer embodiment, similar to that of FIG. 3A while including an exemplary bladder deflation element, according to embodiments of this disclosure.

As illustrated in the exemplary embodiment of FIG. 3C, some packer 132 embodiments may further comprise a bladder deflation element 350 in fluid communication with the interior space 230 of the bladder 220, such as a rupture element/disc which is operable to deflate the bladder 220 upon rupture (e.g. by allowing pressurized fluid/materials in the bladder 220 to exit) and/or configured to reduce the outer diameter of the packer 132 from the set state and to allow extraction of the packer 132 from the wellbore 108. For example, the rupture disc may be configured to be actuated/ruptured by pressure beyond a pre-set level (e.g. in excess of that in the bladder 220). In some embodiments, the bladder deflation element 350 may be formed in the thin-walled skin 225, while in other embodiments the bladder deflation element 350 may seal an evacuation pathway (such as a port) in the mandrel 215 which is in fluid communication with the interior space 230 (such that rupturing or otherwise opening the bladder deflation element 350 will allow the fluid in the bladder 220 to evacuate and thereby deflate the bladder 220). In some embodiments, the bladder deflation element may comprise a valve or retractable plug element (e.g. controlled by a solenoid), which may be activated to open a fluid path to evacuate the fluid within the bladder 220 and/or deflate the bladder 220.

In embodiments, inflation of the bladder 220 (e.g. by injection of pressurized fluid into the cavity 217) may pull the one or more ratchet 330 axially towards the cavity 217, which may provide additional material of the thin-walled skin 225 for radial inflation (thereby allowing for greater radial expansion). In other embodiments, the ratchet 330 can be configured to interact with the pressure injection mechanism 310 (e.g. with the piston 315), such that axial movement of the pressure injection mechanism 310 (e.g. to inject fluid under pressure into the bladder 220 and/or cavity 217) can drive the ratchet 330 axially towards the cavity 217. In still other embodiments, the ratchet 330 can be coupled directly to the pressure injection mechanism 310 (e.g. piston 315) so that the ratchet 330 moves with the pressure injection mechanism 310. In some embodiments, the piston 315 can provide the axial movement towards the cavity 217, and the ratchet 330 may simply act as a lock/block against axial movement away from the cavity 217.

For example, in an exemplary ratchet system 330 which can provide/allow axial translation of the bladder 220, as the bladder 220 inflates, the inflating bladder 220 (e.g. the radial expansion force) can pull the material of the thin-walled skin 225 of the bladder 220, which in turn pulls the ratcheted end of the bladder 220 axially towards the cavity 217 and/or the other end of the bladder. Thus, the force that drives that axial movement can come from the inflation of the bladder 220 itself.

In another exemplary ratchet system 330 for providing axial translation, one end of the bladder 220 may be directly secured to the piston 315 (e.g. with a portion of the piston 315 exposed), so that the axial movement of the piston 315 (e.g. towards the cavity) can directly move the top end of the bladder 220, with the ratchet 330 mechanism just acting as a lock to prevent axial movement away from the cavity after inflation (e.g. with the ratchet 330 really just serving as a locking mechanism which is not really involved in the axial movement of the top of the bladder 220). In embodiments, such ratchet systems 330 could be used above and/or below the cavity 217.

In embodiments, movement of the one or more ratchet 330 (e.g. axial translation of the top and/or bottom of the bladder 220) can have substantially no radial movement. For example, the packer 132 or mandrel 215 may have substantially no wedge portion of its exterior surface and/or the one or more ratchet 330 may have substantially no angled movement (e.g. only axial translation). In embodiments, the axial movement may not exert substantially any compressive force on the sealing element 210. For example, radial expansion of the sealing element 210 may not be caused by compressive force on the sealing element 210 (e.g. radial expansion may only be caused by pressurizing the interior space 230 of the bladder 220 for inflation). In embodiments, only a portion of the radial expansion of the bladder 220 (e.g. less than approximately 25% or 5-30% or 10-25% or 15-25% or 20-25% or 20-30%) may be due to elasticity or ductility of the bladder 220 (e.g. the thin-walled skin 225) during inflation, and/or some portion (e.g. the remainder) of the radial expansion of the sealing element 210 may be attributable (e.g. due) to the axial translation of the bladder 220/thin-walled skin 225 (e.g. providing additional material of the thin-walled skin 225 for radial expansion, which may allow for more radial expansion without any or as much stretching of the bladder 220).

Some embodiments may further comprise a guide 340 disposed in proximity to each side of the cavity 217 and/or the bladder 220. In some embodiments, one or more of the guides 340 may be configured to retain the side of the bladder 220 that is not ratcheted (e.g. the bottom in FIG. 3A) within the cavity 217. In some embodiments, the guides 340 may be configured to support the bladder 220 during inflation. In embodiments, the guide 340 may not contact a wellbore 108/outer tubular element disposed around the mandrel 215 to form the annulus, upon inflation of the bladder 220 and sealing of the annulus. The guide 340 may create a mechanical shoulder for the bladder 220 to rest on. In some embodiments, the guide 340 may be biased towards the cavity, with the inflation of the bladder 220 overcoming the biasing to move the position of the guide 340 (e.g. which may pivot), while the biasing draws the guide 340 into contact with the bladder 220 (e.g. to provide continuous support). As shown in FIGS. 3A-4, the guide 340 may be attached (e.g. mounted) to the ratchet 330.

In embodiments, the pressure rating of the dynamic packer 132 configurations may be approximately 4 times higher, 2-4 times higher, 3-4 times higher, or 4-5 times higher than a static elastomeric inflatable packer fixed at both ends (e.g. without axial movement). This may be particularly true when the thin-walled skin 225 is formed of metal (such as ductile steel), which the dynamic packer 132 configuration may allow to operate effectively in a high-expansion context. In some embodiments, the temperature rating of the packer 132 may be significantly higher than a static elastomeric inflatable packer, particularly when the thin-walled skin 225 is metal or is or includes carbon fiber. For example, the packer 132 with axial movement may operate in temperatures above approximately 400 degrees Fahrenheit (such as 400-600 degrees, 400-550 degrees, 400-500 degrees, 400-450 degrees, 450-550 degrees, or 500-600 degrees).

While the top of the thin-walled skin 225 of the bladder 220 is shown as being configured to axially translate in FIG. 3A (with the bottom position being axially fixed), in alternate embodiments the bottom of the thin-walled skin 225 of the bladder 220 may be configured to axially translate (e.g. upward and/or towards the cavity 217), while the top of the bladder 220 may be axially fixed with respect to the mandrel 215. And while a piston 315 is shown in FIG. 3A as the inflation mechanism for the bladder 220 of the packer 132, other inflation mechanisms may also be used in similar configurations.

FIG. 4 illustrates another embodiment in which both the top and bottom of the bladder 220 may be configured to translate axially towards each other (e.g. to translate axially with respect to the mandrel 215, towards the cavity 217). The embodiment of FIG. 4 may be similar to FIG. 3A, but also includes a second ratchet 430. For example, the second ratchet 430 may be disposed opposite the first ratchet 330, with the cavity 217 therebetween. The second ratchet 430 can secure the other of the top or bottom of the bladder 220 (e.g. the side not secured by the first ratchet 330) to the mandrel 215 (e.g. similar to the first ratchet 330 arrangement described herein with respect to FIG. 3A). For example, in FIG. 4 the first ratchet 330 may secure the top of the bladder 220 (e.g. thin-walled skin 225) to the mandrel 215, and the second ratchet 430 may secure the bottom of the bladder 220 (e.g. thin-walled skin 225) to the mandrel 215. Both the first ratchet 330 and the second ratchet 430 can be configured for axial movement towards the cavity 217 and/or the bladder 220 and/or each other, while preventing axial movement the opposite direction (e.g. away from the cavity 217 and/or bladder 220 and/or each other). Embodiments may also have a seal at an interface between the bladder 220 and each of the ratchets 330, 430.

Disclosed embodiments further include a system for use in a well having the dynamic packer 132 configurations disclosed herein. For example, the system can comprise one or more tubular elements of a tool string 112 configured for insertion into a wellbore 108, and an exemplary dynamic packer 132 (e.g. as disclosed herein, for example with regard to FIGS. 3A-4) which is disposed within the tool string 112 and coupled to at least one of the one or more tubular elements of the tool string 112, for example to allow longitudinal fluid flow through a longitudinal bore of the tool string 112. In some embodiments, the tool string 112 may include a second packer 132 (e.g. similar to the first packer 132), and the packers 132 may be configured to isolate a portion of an annular space around the tool string 112 upon actuation (e.g. a portion located between the two packers 132). System embodiments may further comprise a conveyance mechanism configured to lower and raise the tool string 112 within the wellbore 108. Some embodiments of the tool string 112 may have a perforating gun (e.g. disposed downhole of the packer 132 or between two packers 132). In some embodiments, the tool string 112 may have an electrical submersible pump (ESP), for example disposed between two packers 132. In some embodiments, a nipple may be located at the surface and may be configured to allow for insertion of the tool string 112 (e.g. while preventing leakage of fluid from the well). The run-in outer diameter of the packer 132 may be less than an inner diameter of the nipple, while the set/expanded outer diameter of the packer 132 may be greater than the inner diameter of the nipple (and sufficient to seal the annulus outside the mandrel 215). Some system embodiments can further comprise a hydraulic actuating mechanism for actuating the piston 315 to inflate the bladder 220 of the packer 132. For example, the hydraulic actuating mechanism may include a pump (e.g. typically disposed on the surface) fluidly coupled to the piston 315. In some embodiments, the pump may be configured to actuate the piston 315 via pressurized hydraulic fluid (e.g. through a tube or conduit, which may couple to the cylinder of the piston 315). In other embodiments, the hydraulic actuating mechanism may use a passage between the longitudinal bore and the piston 315, so that wellbore fluid pressure in the bore may actuate the piston 315 (e.g. in conjunction with a ball or plug).

Disclosed embodiments also include methods of making a dynamic packer 132 (e.g. similar to embodiments disclosed herein, for example with respect to FIGS. 3A-4). For example, such methods may comprise: providing a mandrel 215 having a cavity 217 on its external surface, wherein the cavity 217 is configured to fluidly couple to a pressure injection mechanism 310 (e.g. having a piston port therein); coupling a ratchet 330 to an exterior of the mandrel 215 axially above or below the cavity 217, wherein the ratchet 330 is configured to allow for axial movement towards the cavity 217 (e.g. but to prevent movement away from the cavity 217); and securing a side of a bladder thin-walled skin 225 to the ratchet 330; wherein the bladder is configured so that inflation of the bladder 220 via the pressure injection mechanism 310 radially expands the packer 132 outer diameter. Some embodiments may further comprise extending the thin-walled skin 225 across the cavity 217, and fixedly securing a second side of the bladder 220 to the mandrel 215 exterior surface (e.g. opposite the ratchet 330, with the cavity 217 therebetween), such that the second side of the bladder 220 does not move axially. Other embodiments may instead comprise extending the thin-walled skin 225 across the cavity 217, and securing a second side of the bladder 220 to a second ratchet 430 disposed in proximity to the cavity 217, opposite the first ratchet 330 (wherein the second ratchet 430 is attached to the mandrel 215). In embodiments, securing a side of the thin-walled skin 225 may comprise sealingly attaching the thin-walled skin 225 to the one or more ratchet 330.

Method embodiments may further comprise providing the pressure injection mechanism 310 at least partially in the mandrel 215, wherein the pressure injection mechanism 310 comprises a piston 315 in fluid communication with the bladder 220. Embodiments may comprise providing one or more seal 317 on the piston 315, to prevent passage of fluid in the bladder 220 therepast. Some method embodiments may further comprise storing (e.g. in a space in the mandrel 215) uncured concrete (e.g. with an additive to retard curing) for injection into the bladder 220, or storing (e.g. in a space in the mandrel 215) separately reactants for injection into the bladder 220. Embodiments may further comprise attaching one or more guides 340 to the mandrel 215 in proximity to the cavity 217, wherein the one or more guides 340 are configured to support and/or orient the bladder 220 as it inflates. In some embodiments, the guides 340 may be mounted on and/or coupled to the ratchet 330, 430.

Disclosed embodiments may also include methods of sealing an annular space within a wellbore 108 (e.g. using a dynamic packer 132, similar to those shown in FIGS. 3A-4). Such method embodiments may comprise: inserting a tool string 112 having a dynamic packer 132 (e.g. similar to those disclosed herein, for example with respect to FIGS. 3A-4) into the wellbore 108, wherein the wellbore 108 has a restricted area disposed above (e.g. uphole of) an area to be sealed; and after the packer 132 is disposed below (e.g. downhole) of the restricted area and/or in the area to be sealed, actuating (e.g. setting) the packer 132. In embodiments, the restricted area has an inner diameter, the area to be sealed has an inner diameter, and the inner diameter of the area to be sealed may be larger than the inner diameter of the restricted area. In embodiments, the restricted area may be caused by a section of the well that is damaged, collapsed, and/or has debris therein. In embodiments, actuating the packer 132 may inflate the bladder 220 to provide high-expansion radially. For example, actuating the packer 132 may comprise injecting material into the bladder 220 of the packer 132 to inflate the packer 132 (e.g. to provide high expansion radially, such as greater than 150%, greater than 180%, from about 150-400%, from about 180-400%, from about 200-400%, from about 300-400%, from about 180-300%, or from about 200-300%). In embodiments, the wellbore conditions in which the tool string 112 (e.g. the packer 132) operates may be greater than 400 degrees Fahrenheit.

In embodiments, actuating the packer 132 may further comprise providing axial translation of at least one of a top or a bottom of the bladder 220 axially towards the other of the top or the bottom of the bladder 220 (and/or towards a cavity 217 in the mandrel 215 in which the bladder 220 is disposed), to provide additional bladder 220 material for radial expansion of the bladder 220. Some embodiments may comprise providing axial translation of both the top and the bottom of the bladder 220 (e.g. using ratchets). Some embodiments may further comprise, after providing axial translation towards the cavity 217 and/or towards the other side of the bladder 220, preventing axial translation away from the cavity 217 and/or other side of the bladder 220. For example, the ratchet(s) may provide axial translation in only one axial direction and/or may prevent axial translation in the opposite direction.

Providing axial translation may be responsive to or in conjunction with injecting material into the bladder 220, inflating the bladder 220, and/or actuating the packer 132. In some embodiments, injecting material into the bladder 220 can comprise injecting pressurized fluid into the bladder 220. In other embodiments, injecting material can comprise injecting uncured concrete into the bladder 220 and holding the concrete in the bladder 220 until it has cured. In still other embodiments, injecting material can comprise injecting reactants of a foam or polymer into the bladder 220 and holding the materials therein until a solid forms. Inflating the bladder 220 may seal the annulus of the wellbore 108 (e.g. radially beyond the mandrel 215 and/or between the mandrel 215 and the casing or walls of the wellbore 108). In some embodiments, the bladder 220 itself (e.g. the thin-walled skin 225) may not seal the annulus, but rather the solidified material therein may do so.

In embodiments, the restricted area may be disposed below the surface (e.g. not in proximity to the surface), and inserting the tool string 112 may comprise inserting the tool string 112 through a nipple at the surface having a smaller inner diameter than the inner diameter of the area to be sealed (e.g., wherein the inner diameter of the nipple is greater than the inner diameter of the restricted area but less than the inner diameter of the area to be sealed; in other embodiments, the inner diameter of the nipple may be smaller than the inner diameter of the restricted area downhole). In embodiments, a run-in outer diameter of the packer 132 may be less than the inner diameter of the nipple and/or restricted area, and a set/expanded outer diameter of the packer 132 may be significantly larger than the run-in outer diameter (e.g. at least 150% or at least 180%). Method embodiments may further comprise selecting a packer 132 having a sufficiently small run-in outer dimeter to fit within the nipple and restricted area, and having a sufficiently large (e.g. high-expansion) set/expanded outer diameter to effectively seal the annular space (e.g. at least equal to the inner diameter of the area to be sealed). In some embodiments, the unrestricted outer diameter of the packer 132 may be sufficiently greater than the inner diameter of the area to be sealed (e.g. the outer tubular, casing, or wellbore) to providing sufficient sealing and/or anchoring force for the packer 132. Method embodiments may further comprise selecting a packer 132 having a bladder 220 with thin-walled skin 225 formed of a material (e.g. ductile metal) capable of operating at the temperatures and/or pressures in the wellbore (especially in a high-expansion situation).

In embodiments, actuating the packer 132 may comprise actuating a piston 315 configured to direct pressurized fluid into the bladder 220. Some embodiments may comprise guiding and/or supporting the bladder 220 as it inflates (e.g. using one or more guide). Some embodiments may further comprise actuating a bladder deflation element 350 (such as a rupture element/disc) to deflate the packer 132 (e.g. so as to have a deflated outer diameter less than the inner diameter of the nipple and the restricted area); and then extracting/removing the tool string 112 from the wellbore 108. Method embodiments may further comprise attaching the packer 132 within the tool string 112. For example, the mandrel 215 of the packer 132 may be attached, e.g. via screw thread attachment, to a tubular element on one or both ends. Typically, the longitudinal bore of the tool string 112 may extend through the mandrel 215. Embodiments may further comprise producing fluids from the well. For example, once the one or more packers 132 have been radially expanded to seal the annulus, fluid may be pumped downhole through the tool string 112 and/or fluid (e.g. from the formation) may be pumped uphole through the tool string 112.

In some embodiments, a second packer 132 may be disposed either uphole or downhole of the first packer 132. Actuating both packers 132 may isolate a portion of the annular space (e.g. between the packers 132). Some embodiments may further include penetrating the casing (e.g. between the two packers 132) and pumping fluid in the wellbore (e.g. between the two packers 132) uphole through the tool string. Some embodiments may comprise positioning an ESP downhole within the tool string, e.g. between the two packers 132, and operating the ESP to pump fluids uphole.

So as shown in FIGS. 3A-3B, axial movement of the bladder 220 may provide additional material of the thin-walled skin 225 for radial expansion (e.g. allowing greater radial expansion of the packer bladder 220/sealing element 210). This may provide for larger expansion possibilities (e.g. greater than 150% or greater than 180%) than embodiments without such axial translation. For example, for bladders 220 formed of the same thin-walled skin 225 material, embodiments with axial translation (e.g. as shown in FIGS. 3A-3B) can provide additional radial expansion than embodiments without axal translation (e.g. as shown in FIGS. 2A-2B). Thus, axial translation configurations may allow for greater expansion in some embodiments. Axial translation configurations may also allow for the needed radial expansion for sealing in a particular (e.g. high-expansion) situation using materials that are not elastomeric and/or which have lower elasticity, ductility, etc. For example, the thin-walled skin 225 of the embodiment shown in FIG. 3A may be formed of or comprise metal or composite material. By allowing for the use of additional materials for the packer sealing element 210, the packer 132 may be operable in well conditions that were not possible using standard elastomeric materials.

ADDITIONAL DISCLOSURE

The following are non-limiting, specific embodiments in accordance with the present disclosure:

In a first embodiment, a packer comprises: a mandrel having a tubular body (for example, with a longitudinally extending bore therethrough which has an axis); a sealing element (e.g. sleeve) having an inflatable bladder disposed about an exterior of the mandrel tubular body (e.g, wherein inflation of the bladder results in radial expansion of the bladder); and an actuation element/mechanism configured to inflate the bladder upon actuation; wherein the bladder is secured to the mandrel, and wherein at least one of a top and a bottom of the bladder is configured to dynamically translate/move/displace axially toward the other of the top and the bottom of the bladder upon actuation of the packer (e.g. responsive to inflation of the bladder, responsive to injection of pressurized fluid into the bladder, responsive to movement of the actuation mechanism, etc.).

A second embodiment can include the packer of the first embodiment, wherein the packer has a run-in state in which the bladder is uninflated (e.g. the outer diameter of the bladder is substantially the same as the outer diameter of the mandrel), and a set state in which the bladder is inflated (e.g. having an outer diameter significantly larger (e.g. at least 150% or at least 180%) than the run-in outer diameter and/or configured to seal an annulus of a wellbore to prevent passage of fluid in the annulus).

A third embodiment can include the packer of the first or second embodiment, wherein the actuation mechanism comprises a pressure injection mechanism configured to inflate the bladder upon actuation (e.g. by injecting pressurized fluid/material therein).

A fourth embodiment can include the packer of any one of the first to third embodiments, wherein the bladder is secured to the mandrel by having both the top and the bottom of the bladder secured to the mandrel (although at least one of the top or bottom of the bladder may be secured to the exterior of the mandrel in a manner allowing for dynamic axial movement).

A fifth embodiment can include the packer of any one of the first to fourth embodiments, wherein the axial translation of the bladder is configured to produce greater radial expansion of the bladder during inflation.

A sixth embodiment can include the packer of any one of the first to fifth embodiments, wherein radial expansion of the bladder is greater than 150%, greater than 180%, from about 150-400%, from about 180-400%, from about 180-300%, from about 180-200%, from about 200-400%, from about 300-400%, from about 200-300%, or even over 400% in some embodiments.

A seventh embodiments can include a packer of any one of the first to sixth embodiments, wherein stress in the thin-walled skin of the bladder (e.g. after inflation and/or radial expansion) is lower than if no axial translation had occurred.

An eighth embodiment can include a packer of any one of the first to seventh embodiments, wherein greater radial expansion is possible with less packer/seal element length.

A ninth embodiment can include a packer of any one of the first to eighth embodiments, wherein one of the top and the bottom of the bladder is configured for axial translation and the other of the top and the bottom of the bladder is fixed (e.g. is configured to not allow axial movement/translation during actuation/inflation).

A tenth embodiment can include a packer of any one of the first to ninth embodiments, wherein both the top and bottom of the bladder are configured for axial translation (e.g. towards each other and/or towards a cavity in the mandrel).

An eleventh embodiment can include the packer of any one of the first to tenth embodiments, wherein the mandrel comprises a cavity in its exterior surface (e.g. an inset portion, typically extending circumferentially around the mandrel), and wherein the bladder comprises a thin-walled skin disposed over (e.g. covering) the cavity (e.g. to form a sealed interior space of the bladder).

A twelfth embodiment can include the packer of the eleventh embodiment, wherein the thin-walled skin comprises a sleeve disposed about the mandrel and sealingly attached to the mandrel (e.g. in proximity to the cavity).

A thirteenth embodiment can include the packer of any one of the eleventh or twelfth embodiments, wherein the thin-walled skin spans the opening of the cavity to create the interior space for inflation via the pressurized fluid/materials (e.g. with only an opening in fluid communication with the piston port).

A fourteenth embodiment can include the packer of any one of the eleventh to thirteenth embodiments, wherein the interior space of the bladder for inflation is formed between the thin-walled skin and an inner surface of the cavity of the mandrel (e.g. a sealed space of the cavity sealingly covered by the thin-walled skin).

A fifteenth embodiment can include the packer of any one of the eleventh to the thirteenth embodiments, wherein the thin-walled skin comprises an inner panel disposed in contact with, against, and/or in proximity to an inner wall of the cavity.

A sixteenth embodiment can include the packer of the fifteenth embodiment, wherein the inner panel extends substantially a length of the cavity (e.g. from the bottom of the bladder to the top of the bladder).

A seventeenth embodiment can include the packer of any one of the fifteenth to sixteenth embodiments, wherein the thin-walled skin further comprises an exterior panel spanning the cavity, wherein the inner panel is connected to the exterior panel of the thin-walled skin to form an envelope disposed within the cavity and configured to expand upon inflation.

An eighteenth embodiment can include the packer of any one of the fifteenth to the seventeenth embodiments, wherein the interior space of the bladder is disposed within an envelope formed by the thin-walled skin (e.g. between the inner panel and the exterior panel).

A nineteenth embodiment can include the packer of any one of the eleventh to the eighteenth embodiments, wherein the pressure injection mechanism is configured to hydraulically inject fluid into the interior space of the bladder.

A twentieth embodiment can include the packer of any one of the eleventh to the nineteenth embodiments, wherein the pressure injection mechanism is a piston disposed in the mandrel (e.g. in a cylinder formed in the mandrel) and in fluid communication with the interior space of the bladder.

A twenty-first embodiment can include the packer of the twentieth embodiment, wherein the piston comprises one or more seal (e.g. configured to prevent fluid in the bladder from leaking therepast, e.g. into the cylinder of the mandrel).

A twenty-second embodiment can include the packer of the twentieth or twenty-first embodiments, wherein the piston comprises a check valve configured to allow for passage of hydraulic fluid for activation of the piston into the interior space of the bladder for inflation of the bladder (e.g. after the compression stroke of the piston is completed).

A twenty-third embodiment can include the packer of any one of the eleventh to the twenty-second embodiments, wherein the thin-walled skin comprises a surface that is impenetrable to fluid (e.g. wellbore fluid) and is configured to contain pressurized fluid therein.

A twenty-fourth embodiment can include the packer of any one of the eleventh to the twenty-second embodiments, wherein the thin-walled skin comprises a mesh surface, wherein the mesh size is sufficiently small to retain material in the bladder (e.g. while it solidifies), and/or wherein solidified material is configured to form an annular seal.

A twenty-fifth embodiment can include the packer of any one of the eleventh to the twenty-second embodiments, wherein the thin-walled skin comprises one or more openings or pores, wherein the opening size is sufficiently small to retain material in the bladder (e.g. while it solidifies), and/or wherein solidified material is configured to form an annular seal.

A twenty-sixth embodiment can include the packer of the twenty-third embodiment, wherein the pressurized fluid is wellbore fluid.

A twenty-seventh embodiment can include the packer of the twenty-third embodiment, wherein the pressurized fluid is not wellbore fluid (e.g. different than wellbore fluid, such as hydraulic fluid).

A twenty-eighth embodiment can include the packer of the twenty-fourth or twenty-fifth embodiments, wherein the material retained in the bladder is configured to be flowable initially (e.g. during injection) and to solidify and/or seal while disposed within the bladder.

A twenty-ninth embodiment can include the packer of the twenty-eighth embodiment, wherein the material retained in the bladder comprises uncured cement.

A thirtieth embodiment can include the packer of the twenty-ninth embodiment, wherein the material further comprises a retardant additive configured to delay setting of the cement.

A thirty-first embodiment can include the packer of the twenty-eighth embodiment, wherein the material injected to inflate the bladder comprises reactants of a two-part epoxy or foam.

A thirty-second embodiment can include the packer of the thirty-first embodiment, wherein injection of the material comprises breaking/opening/unsealing/piercing containers holding reactants separately to allow mixing thereof.

A thirty-third embodiment can include the packer of any one of the first to thirty-second embodiments, further comprising a ratchet configured for axial movement in one direction (e.g. towards the cavity and/or the bladder), while preventing axial movement the opposite direction (e.g. away from the cavity and/or bladder), wherein the ratchet secures one of the top or bottom of the bladder to the mandrel (e.g. with the thin-walled skin fixedly attached to the ratchet, and the ratchet attached to the exterior of the mandrel so as to allow/provide axial translation of the bladder).

A thirty-fourth embodiment can include the packer of the thirty-third embodiment, further comprising a second ratchet disposed opposite the first ratchet with the cavity therebetween, wherein the second ratchet is configured for axial movement towards the cavity and/or the bladder, while preventing axial movement the opposite direction (e.g. away from the cavity and/or bladder), and wherein the second ratchet secures the other of the top or bottom of the bladder to the mandrel (e.g. similar to the first ratchet arrangement).

A thirty-fifth embodiment can include the packer of the thirty-third or thirty-fourth embodiments, further comprising a seal at an interface between the bladder and the one or more ratchet.

A thirty-sixth embodiment can include the packer of any one of the eleventh to the thirty-fifth embodiments, wherein the thin-walled skin is elastomeric (e.g. comprises elastomeric material).

A thirty-seventh embodiment can include the packer of any one of the eleventh to the thirty-fifth embodiments, wherein the thin-walled skin is non-elastomeric.

A thirty-eighth embodiment can include the packer of any one of the eleventh to the thirty-fifth embodiments, wherein the thin-walled skin is formed of or comprises metal (e.g. ductile steel, such as 316 stainless steel) or composite material (such as carbon fiber impregnated elastomer).

A thirty-ninth embodiment can include the packer of any one of the first to thirty-eighth embodiments, further comprising a bladder deflation element (such as a rupture element/disc operable to deflate the bladder upon rupture (e.g. by allowing pressurized fluid/materials in the bladder to exit) or comprising a valve or retractable plug (which may be operated by a solenoid) in fluid communication with the interior space of the bladder and providing an exit path for fluid in the bladder upon opening) which may be configured to reduce, upon activation, the outer diameter of the packer from the set state and to allow extraction of the packer from the wellbore.

A fortieth embodiment can include the packer of the thirty-ninth embodiment, wherein the rupture disc is configured to be actuated/ruptured by pressure beyond a pre-set level (e.g. in excess of that in the bladder).

A forty-first embodiment can include the packer of any one of thirty-third to fortieth embodiments, wherein inflation of the bladder (e.g. by injection of pressurized fluid into the cavity) pulls the ratchet axially towards the cavity (e.g. thereby providing additional material of the thin-walled skin for radial inflation); wherein the ratchet is configured to interact with the piston of the pressure injection mechanism, whereby axial movement of the piston e.g. (to inject fluid under pressure into the bladder and/or cavity) drives the ratchet axially towards the cavity; or wherein the ratchet is coupled to the piston so that the ratchet moves with the piston (for example, with the piston providing the axial movement towards the cavity and the ratchet just acting as a lock against axial movement away from the cavity).

A forty-second embodiment can include the packer of any one of the thirty-third to forty-first embodiments, wherein movement of the one or more ratchet (e.g. axial translation of the top and/or bottom of the bladder) has substantially no radial movement.

A forty-third embodiment can include the packer of any one of the first to forty-second embodiments, wherein the axial movement does not exert substantially any compressive force on the sealing element and/or wherein radial expansion of the sealing element is not caused by compressive force on the sealing element (e.g. radial expansion is only caused by pressurizing the interior space of the bladder).

A forty-fourth embodiment can include the packer of any one of the first to forty-third embodiments, wherein only a portion of the radial expansion of the bladder is due to elasticity or ductility of the bladder (e.g. the thin-walled skin), while the remainder of the radial expansion is attributable (e.g. due to) the axial translation of the bladder/thin-walled skin.

A forty-fifth embodiment can include the packer of any one of the first to forty-fourth embodiments, further comprising a guide disposed in proximity to each side of the cavity and/or bladder and configured to support the bladder during inflation.

A forty-sixth embodiment can include the packer of the forty-fifth embodiment, wherein the guide does not contact a wellbore/outer tubular element (e.g. disposed around the mandrel, which the bladder is configured to seal against) upon inflation of the bladder and sealing of the annulus.

A forty-seventh embodiment can include the packer of the forty-fifth or forty-sixth embodiments, wherein the guide is attached/mounted to the ratchet.

In a forty-eighth embodiment, a system for operating a well comprises: one or more tubular elements of a tool string configured for insertion into a wellbore; and the packer of any one of the first to forty-seventh embodiments disposed within the tool string and coupled to at least one of the one or more tubular elements of the tool string so as to allow longitudinal fluid flow through a longitudinal bore of the tool string.

A forty-ninth embodiment can include the system of the forty-eighth embodiment, further comprising a conveyance mechanism configured to lower and raise the tool string within the wellbore.

A fiftieth embodiment can include the system of the forty-eighth or forty-ninth embodiments, wherein the tool string further comprises a perforating gun (e.g. disposed downhole of the packer).

A fifty-first embodiment can include the system of any one of the forty-eighth to fiftieth embodiments, wherein the tool string further comprises a second packer (e.g. similar to the first packer), and the packers are configured to isolate a portion of an annular space around the tool string upon actuation.

A fifty-second embodiment can include the system of the fifty-first embodiment, wherein the tool string further comprises an electrical submersible pump (ESP) disposed between the two packers.

A fifty-third embodiment can include the system of any one of the forty-eighth to fifty-second embodiments, further comprising a nipple at the surface configured to allow insertion of the tool string (e.g. while preventing leakage of fluid from the well), wherein the run-in outer diameter of the packer is less than an inner diameter of the nipple, and wherein the set/expanded outer diameter of the packer is greater than the inner diameter of the nipple (and sufficient to seal the annulus outside the mandrel).

A fifty-fourth embodiment can include any one of the forty-eighth to the fifty-third embodiments, further comprising a hydraulic actuating mechanism for actuating the piston to inflate the bladder of the packer, wherein the hydraulic actuating mechanism further comprises a pump (e.g. typically disposed on the surface) fluidly coupled to the piston and/or wherein the hydraulic actuating mechanism further comprises a passage between the longitudinal bore and the piston (e.g. with fluid pressure in the bore actuating the piston).

In a fifty-fifth embodiment, a method of making a packer comprises: providing a mandrel having a cavity on its external surface, wherein the cavity is fluidly coupled to a pressure injection mechanism; coupling a ratchet to an exterior of the mandrel axially above or below the cavity, wherein the ratchet is configured to allow for axial movement towards the cavity (e.g. but to prevent movement away from the cavity); and securing a side of a bladder thin-walled skin to the ratchet; wherein inflation of the bladder via the pressure injection mechanism radially expands a packer outer diameter.

A fifty-sixth embodiment can include the method of the fifty-fifth embodiment, further comprising extending the thin-walled skin across the cavity and fixedly securing a second side of the bladder to the mandrel exterior surface (e.g. opposite the ratchet, with the cavity therebetween).

A fifty-seventh embodiment can include the method of the fifty-fifth embodiment, further comprising extending the thin-walled skin across the cavity and securing a second side of the bladder to a second ratchet disposed in proximity to the cavity, opposite the first ratchet.

A fifty-eighth embodiment can include the method of any one of the fifty-fifth to fifty-seventh embodiments, wherein inflation of the bladder pulls the one or more ratchet axially towards the cavity (e.g. thereby providing additional material of the thin-walled skin for radial inflation); wherein the ratchet is configured to interact with the pressure injection mechanism, whereby axial movement of the pressure injection mechanism drives the ratchet axially towards the cavity; or wherein the ratchet is coupled to the pressure injection mechanism so that the ratchet moves with the pressure injection mechanism.

A fifty-ninth embodiment can include the method of any one of the fifty-fifth to fifty-eighth embodiments, further comprising providing the pressure injection mechanism in the mandrel, wherein the pressure injection mechanism comprises a piston in fluid communication with the bladder.

A sixtieth embodiment can include the method of the fifty-fifth embodiment, wherein securing a side of the thin-walled skin comprises sealingly attaching the thin-walled skin to the ratchet A sixty-first embodiment can include the method of the fifty-ninth embodiment, further comprising providing one or more seal on the piston, to prevent passage of fluid in the bladder therepast.

A sixty-second embodiment can include the method of any one of the fifty-fifth to sixty-first embodiments, further comprising storing (e.g. in a space in the mandrel) uncured concrete (e.g. with an additive to retard curing) for injection into the bladder.

A sixty-third embodiment can include the method of any one of the fifty-fifth to sixty-first embodiments, further comprising storing (e.g. in a space in the mandrel) separately reactants for injection into the bladder.

A sixty-fourth embodiment can include the method of any one of the fifty-fifth to sixty-third embodiments, further comprising attaching one or more guides to the mandrel in proximity to the cavity, wherein the one or more guides are configured to support and/or orient the bladder as it inflates.

In a sixty-fifth embodiment, a method of sealing an annular space within a wellbore comprises: inserting a tool string having a packer (e.g. as in any one of the first to forty-seventh embodiments) into the wellbore, wherein the wellbore has a restricted area disposed above (e.g. uphole of) an area to be sealed; and after the packer is disposed below (e.g. downhole) of the restricted area and/or in the area to be sealed, actuating (e.g. setting) the packer; wherein the restricted area has an inner diameter, the area to be sealed has an inner diameter, and the inner diameter of the area to be sealed is larger than the inner diameter of the restricted area.

A sixty-sixth embodiment can include the method of the sixty-fifth embodiment, wherein actuating the packer inflates the bladder to provide high-expansion radially.

A sixty-seventh embodiment can include the method of the sixty-fifth or sixty-sixth embodiments, wherein actuating the packer comprises injecting material into the bladder of the packer to inflate the packer (e.g. greater than 150%, greater than 180%, from about 150-400%, from about 180-400%, from about 200-400%, from about 300-400%, from about 180-300%, or from about 200-300%).

A sixth-eighth embodiment can include the method of any one of the sixty-fifth to sixty-seventh embodiments, wherein the wellbore conditions are greater than 400 degrees Fahrenheit.

A sixty-ninth embodiment can include the method of any one of the sixty-fifth to sixty-eighth embodiments, wherein actuating the packer further comprises providing axial translation of at least one of a top or a bottom of the bladder axially towards the other of the top or the bottom of the bladder, to provide additional bladder material for radial expansion of the bladder.

A seventieth embodiment can include the method of the sixty-ninth embodiment, wherein providing axial translation is responsive to/in conjunction with injecting material into the bladder.

A seventy-first embodiment can include the method of any one of the sixty-seventh to seventieth embodiments, wherein injecting material into the bladder comprises injecting pressurized fluid into the bladder.

A seventy-second embodiment can include the method of any one of the sixty-seventh to seventieth embodiments, wherein injecting material comprises injecting uncured concrete into the bladder and holding the concrete in the bladder until it has cured.

A seventy-third embodiment can include the method of any one of the sixty-seventh to seventieth embodiments, wherein injecting material comprises injecting reactants of a foam or polymer into the bladder and holding the materials therein until a solid forms.

A seventy-fourth embodiment can include the method of the seventy-second or seventy-third embodiments, wherein the bladder comprises a mesh.

A seventy-fifth embodiment can include the method of any one of the sixty-sixth to seventy-fourth embodiments, wherein inflating the bladder seals the annulus of the wellbore.

A seventy-sixth embodiment can include the method of any one of the seventy-second to seventy-fifth embodiments, wherein the bladder itself (e.g. the thin-walled skin) does not seal the annulus, but the solidified material therein does so.

A seventy-seventh embodiment can include the method of any one of the sixth-fifth to seventy-sixth embodiments, wherein the restricted area is disposed below the surface, wherein inserting the tool string comprises inserting the tool string through a nipple at the surface with a smaller inner diameter than the inner diameter of the area to be sealed (e.g., wherein the inner diameter of the nipple is greater than the inner diameter of the restricted area but less than the inner diameter of the area to be sealed).

A seventy-eighth embodiment can include the method of the seventy-seventh embodiment, wherein a run-in outer diameter of the packer is less than the inner diameter of the nipple and/or restricted area, and wherein a set/expanded outer diameter of the packer is significantly larger than the run-in outer diameter (e.g. at least 150% or at least 180%).

A seventy-ninth embodiment can include the method of any of the sixty-fifth to seventy-eighth embodiments, wherein actuating the packer comprises actuating a piston configured to direct pressurized fluid into the bladder.

An eightieth embodiment can include the method of any one of the sixty-fifth to seventy-ninth embodiments, further comprising actuating a bladder deflation element to deflate the packer (e.g. so as to have a deflated outer diameter less than the inner diameter of the nipple and the restricted area); and then extracting/removing the tool string from the wellbore.

An eighty-first embodiment can include the method of any one of the seventy-seventh to eightieth embodiments, further comprising selecting a packer having a sufficiently small run-in outer dimeter to fit within the nipple and restricted area and a sufficiently large (e.g. high-expansion) set outer diameter to effectively seal the annular space (e.g. at least equal to the inner diameter of the area to be sealed).

An eighty-second embodiment can include the method of any one of the sixty-fifth to eighty-first embodiments, further comprising attaching the packer within the tool string (e.g. attaching, e.g. via screw thread attachment, the mandrel of the packer to a tubular element on one or both ends, whereby the longitudinal bore of the tool string extends through the mandrel).

An eighty-third embodiment can include the method of any one of the sixty-fifth to eighty-second embodiments, further comprising producing fluids from the well.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. An inflatable packer comprising:

a mandrel having a tubular body;

a sealing element having an inflatable bladder disposed about an exterior of the mandrel tubular body;

an actuation mechanism configured to inflate the bladder upon actuation;

a first ratchet; and a second ratchet wherein: the bladder is secured to the mandrel, both a top and a bottom of the bladder is configured to dynamically translate axially toward the other of the top and the bottom of the bladder upon actuation of the packer, axial translation of the bladder is configured to result in radial expansion of the bladder during inflation from approximately 180-400%, the mandrel comprises a cavity in its exterior surface, the bladder comprises a thin-walled skin disposed over the cavity, the thin-walled skin comprises metal, the second ratchet is disposed opposite the first ratchet with the cavity therebetween, each of the first and second ratchet is configured for axial movement towards the cavity, while preventing axial movement away from the cavity, and secures one of the top or bottom of the bladder to the mandrel so as to provide axial translation thereof.

2. The packer of claim 1, wherein the sealing element comprises a run-in state, in which the bladder is uninflated, and a set state, in which the bladder is inflated.

3. The packer of claim 1, wherein both the top and the bottom of the bladder are configured for axial translation towards each other.

4. The packer of claim 1, wherein the pressure injection mechanism is a piston disposed in the mandrel and in fluid communication with an interior space of the bladder.

5. The packer of claim 1, wherein inflation of the bladder pulls the first and the second ratchets axially towards the cavity.

6. The packer of claim 1, wherein at least a portion of the radial expansion is attributable to the axial translation of the bladder.

7. The packer of claim 1, wherein the metal of the thin-walled skin comprises ductile steel.

8. The packer of claim 1, wherein axial translation of the bladder is configured to result in radial expansion of the bladder during inflation of approximately 300-400%.

9. A system comprising:

one or more tubular elements of a tool string configured for insertion into a wellbore; and the inflatable packer of claim 1 disposed within the tool string and coupled to at least one of the one or more tubular elements of the tool string so as to allow longitudinal fluid flow through a longitudinal bore of the tool string.

10. The system of claim 9, wherein the tool string further comprises a second packer, similar to the first packer, and the packers are configured to jointly isolate a portion of an annular space around the tool string upon actuation.

11. The system of claim 10, wherein the tool string further comprises an electrical submersible pump disposed in the isolated portion between the packers.

12. A method of sealing an annular space comprising:

inserting a tool string having the inflatable packer of claim 1 into a wellbore, wherein the wellbore has a restricted area disposed uphole of an area to be sealed; and after the packer is disposed downhole of the restricted area and in the area to be sealed, actuating the packer;

wherein the restricted area has an inner diameter, the area to be sealed has an inner diameter, and the inner diameter of the area to be sealed is larger than the inner diameter of the restricted area;

wherein actuating the packer inflates a bladder about 180-400%; and wherein actuating the packer comprises injecting material into the bladder, and providing axial translation of both the top and the bottom of the bladder axially towards each other, to provide additional bladder material for radial expansion of the bladder.

13. The method of claim 12, wherein injecting material comprises injecting uncured concrete into the bladder and holding the concrete in the bladder until it has cured.

14. The method of claim 12, wherein injecting material comprises injecting reactants of a foam or polymer into the bladder and holding the material as the reactants jointly form a solid foam or polymer.

* * * * *